US008963975B2

(12) United States Patent
Tomomatsu et al.

(10) Patent No.: US 8,963,975 B2
(45) Date of Patent: Feb. 24, 2015

(54) PRINTER AND PRINTING METHOD

(71) Applicant: Brother Kogyo Kabushiki Kaisha, Nagoya-shi, Aichi-ken (JP)

(72) Inventors: Yoshitsugu Tomomatsu, Nagoya (JP); Junya Kawai, Nagoya (JP); Hidekazu Ishii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/227,483

(22) Filed: Mar. 27, 2014

(65) Prior Publication Data

US 2014/0362157 A1 Dec. 11, 2014

(30) Foreign Application Priority Data

Jun. 5, 2013 (JP) ..... 2013-118767

(51) Int. Cl.
*B41J 11/00* (2006.01)
*B41J 11/66* (2006.01)

(52) U.S. Cl.
CPC ..... *B41J 11/663* (2013.01)
USPC ..... 347/218

(58) Field of Classification Search
USPC ..... 347/16, 171, 211, 213–215, 217–219, 347/221, 222; 400/611, 613, 621, 621.1
See application file for complete search history.

(56) References Cited

U.S. PATENT DOCUMENTS

| | | | | |
|---|---|---|---|---|
| 6,412,993 | B1 * | 7/2002 | Silverbrook | 400/621 |
| 7,318,681 | B2 * | 1/2008 | Kato et al. | 400/621 |
| 7,628,482 | B2 * | 12/2009 | Izumi | 347/218 |
| 7,791,627 | B2 * | 9/2010 | Sakurai et al. | 347/218 |
| 8,591,127 | B2 * | 11/2013 | McNestry et al. | 347/213 |
| 2005/0123335 | A1 * | 6/2005 | Heiles et al. | 400/621 |
| 2007/0081847 | A1 * | 4/2007 | Acher | 400/621 |

FOREIGN PATENT DOCUMENTS

JP H07-137377 A 5/1995

* cited by examiner

*Primary Examiner* — Kristal Feggins
(74) *Attorney, Agent, or Firm* — Banner & Witcoff, Ltd.

(57) ABSTRACT

The disclosure discloses a printer comprising a printing-head, a cutter, a print object receiving portion, an increment mode receiving portion, a cutting mode receiving portion, and a printing control portion. The printer continually produces a plurality of printed matter wherein the print object is respectively formed in a predetermined order. The print object receiving portion receives an input operation for the print object which is disposed in at least one block that includes a print identifier that can be incremented. The increment mode receiving portion receives a setup operation for an increment mode. The cutting mode receiving portion receives a setup operation for a cutting mode at a boundary. The printing control portion controls the feeder and the printing-head to generate a plurality of the printed matter in which is respectively formed the print object which includes the print identifier incremented, and which is cut using the cutting mode.

6 Claims, 12 Drawing Sheets

PRINTER AND PRINTING METHOD

CROSS-REFERENCE TO RELATED APPLICATION

The present application claims priority from Japanese Patent Application No. 2013-118767, which was filed on Jun. 5, 2013, the disclosure of which is incorporated herein by reference in its entirety.

BACKGROUND

1. Field

The present disclosure relates to a printer and printing method that continually produces a plurality of printed matter, each comprising a print object.

2. Description of the Related Art

In the past, there have been known printers that continually produce a plurality of printed matter, each comprising a print object. According to such a printer (tape printing apparatus), print formation of the print object (characters and symbols) is performed by printing means (a thermal head) on a print-receiving tape (laminated film tape) fed by feeding means (connecting rollers), thereby continually producing a plurality of printed matter (labels), each comprising the print object. The print object includes a print identifier (number) that can be incremented in accordance with a predetermined regularity when the plurality of printed matter is continually produced.

Further, according to the prior art, the operator can set various settings related to the increment of the print identifier. That is, the operator can perform setup operations of the print identifier specification, the increment execution count, and the like when the print identifier is to be incremented.

Nevertheless, according to the prior art, in a case where a plurality of printed matter is produced while incrementing a print identifier using various modes as described above, no particular consideration is given to the cutting settings related to the plurality of printed matter. That is, only a setting whereby the print-receiving tape is cut after the entire plurality of printed matter has been continually formed (the entire plurality of printed matter has been formed as an integrated object) is prepared in a fixed manner, resulting in low convenience for the operator.

SUMMARY

It is therefore an object of the present disclosure to provide a printer and a printing method capable of cutting a printed matter when a plurality of printed matter is produced while a print identifier is sequentially incremented at a cutting position corresponding to the increment and improving operator convenience.

MEANS FOR SOLVING THE PROBLEMS

In order to above-described object, according to the aspect of the present application, there is provided a printer comprising a feeder configured to feed a print-receiving tape; a printing-head configured to perform desired printing of a print object on the print-receiving tape fed by the feeder; and a cutter configured to cut the print-receiving tape on which printing has been performed by the printing-head; the printer being configured to continually produce a plurality of printed matter wherein the print object is respectively formed on the print-receiving tape in a predetermined order along a feeding direction of the feeder, and further comprising a print object receiving portion configured to receive an input operation for the print object which is disposed in at least one block that can be set in a tape length direction in relation to a single the printed matter and includes a print identifier that can be incremented in accordance with a predetermined regularity; an increment mode receiving portion configured to receive a setup operation for an increment mode when the print identifier of the print object is to be incremented; a cutting mode receiving portion configured to receive a setup operation for a cutting mode by the cutter at a boundary between two adjacent printed matter included in the plurality of printed matter, in accordance with the increment mode received by the increment mode receiving portion; and a printing control portion configured to control the feeder and the printing-head to generate a plurality of the printed matter in which is respectively formed the print object which includes the print identifier incremented in accordance with a reception result of the print object receiving portion and the increment mode receiving portion, and which is cut using the cutting mode received by the cutting mode receiving portion.

DETAILED DESCRIPTION OF THE PREFERRED EMBODIMENTS

The following describes an embodiment of the present disclosure with reference to accompanying drawings.

Outer Appearance Configuration of Print Label Producing Apparatus

Figure 1:
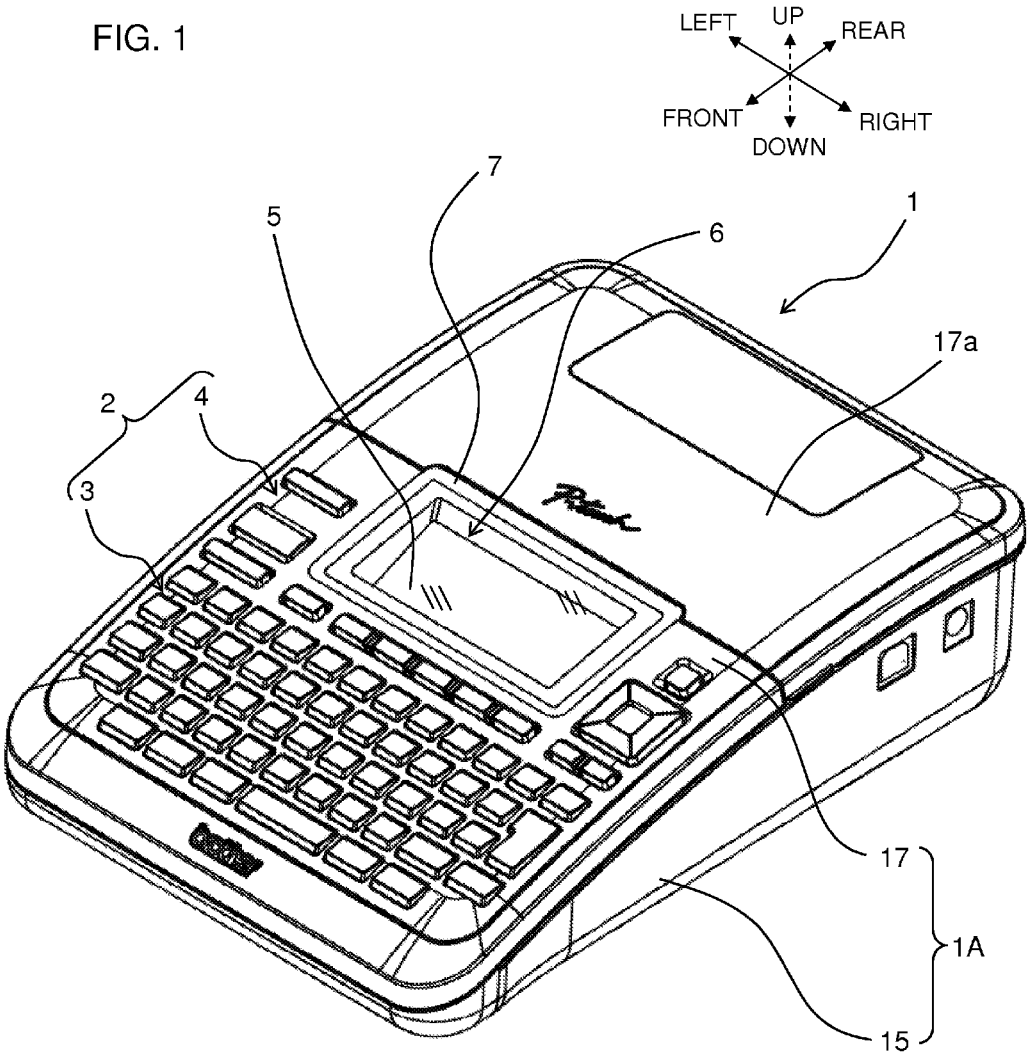
FIG. 1 is a perspective view showing the outer appearance of a print label producing apparatus of an embodiment of the present disclosure.

As shown in FIG. 1, a print label producing apparatus 1 of this embodiment comprises a housing 1A constituting an outer frame. The housing 1A comprises a resin lower cover 15 constituting an apparatus lower surface and an apparatus side surface, and a resin upper cover 17 constituting an apparatus upper surface. The upper cover 17 comprises a cartridge cover 17*a* that covers a cartridge holder 9 (refer to FIG. 2 described later) on a rear portion side, and the cartridge cover 17*a* is capable of opening and closing with the rear end portion serving as the fulcrum point. An opening 6 of a rectangular opening shape, for example, adjacent to the cartridge cover 17*a* and a transparent panel 7 mounted so as to block this opening 6 are disposed on the front portion side of the upper cover 17, and a display portion 5 comprising a liquid crystal display, for example, for displaying input characters, symbols, and the like is disposed on the inner side of the opening 6. An operation portion 2 is disposed around the opening 6. A keyboard 3 whereby various operations such as character input are performed, and a function key group 4 for executing various functions of the print label producing apparatus 1, including a power switch, print key, and the like, are disposed on the operation portion 2, from the front direction toward the rear direction of the upper cover 17.

A main substrate (not shown) on which electronic elements (an IC chip and the like) constituting a control circuit 210 (refer to FIG. 3 described later) and the like described later are mounted, and a key substrate (not shown) connected to the above described control circuit 210 of the main substrate via a connector are disposed on the lower side of the display portion 5, for example, in the interior of the housing 1A. The key substrate comprises a plurality of key contacts disposed in positions corresponding to the respective keys constituting the above described keyboard 3 and function key group 4, and these key contacts are closed when the operator operates the respective keys of the keyboard 3 and the function key group 4, thereby executing the functions assigned to the respective keys.

Cartridge Holder and Surrounding Configuration

Figure 2:
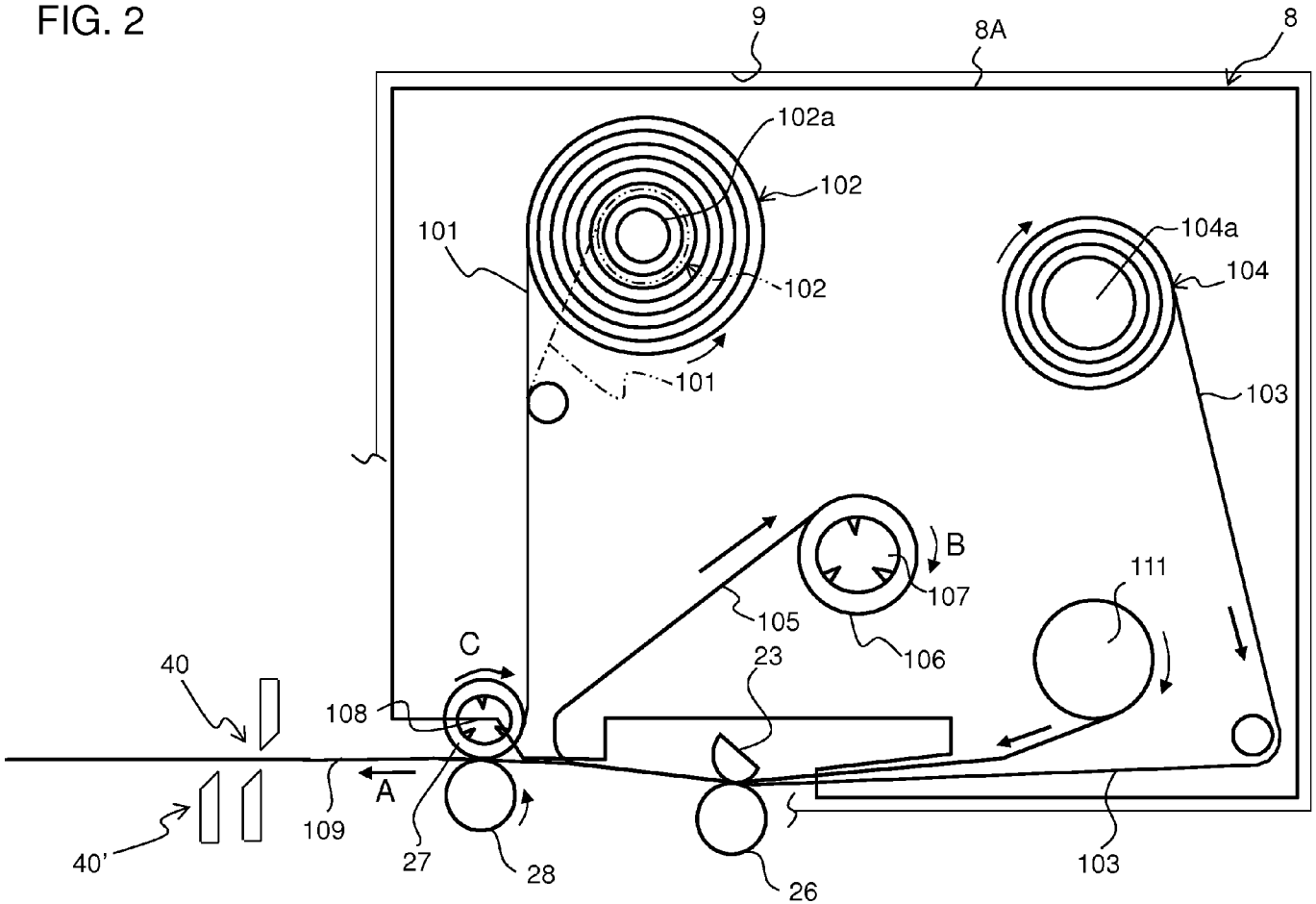
FIG. 2 is an enlarged plan view schematically showing the inner structure of a cartridge.

As shown in FIG. 2, the above described cartridge holder 9, from which a cartridge 8 for supplying a label tape 109 with print is detachable, is disposed on the inner side of the cartridge cover 17*a* of the housing 1A. This cartridge holder 9 is continually covered by the above described cartridge cover 17*a*, and is exposed when the cartridge cover 17*a* is opened. A ribbon take-up roller driving shaft 107 for taking up a used ink ribbon 105 inside the cartridge 8, and a feeding roller driving shaft 108 for feeding a cover film 103 inside the cartridge 8 are disposed on the cartridge holder 9.

Further, a thermal head 23 that performs desired printing on the cover film 103 is disposed on the cartridge holder 9 so that it is positioned at an opening thereof when the cartridge 8 is mounted. The thermal head 23 comprises a plurality of heating elements 23*a* (refer to FIG. 3 described later) arranged in a direction orthogonal to the feeding direction of the cover film 103, forming at least respective dots on the respective print lines that divide the cover film 103 into print resolutions in the feeding direction based on the control of a print-head driving circuit 205 (refer to FIG. 3 described later). As a result, printing of the desired print object (a character string or the like, for example) is performed on the cover film 103.

The cartridge 8 comprises a housing 8A; a first roll 102 (actually in a spiral shape, but simply shown in a concentric shape in the figure) around which is wound a strip base tape 101, disposed inside this housing 8A; a second roll 104 (actually in a spiral shape, but simply shown in a concentric shape in the figure) around which is wound the transparent above described cover film 103 with substantially the same width as that of the above described base tape 101; a ribbon supply side roll 111 around which is wound the above described ink ribbon 105 (heat transfer ribbon, which is not required in a case of employing a thermal tape as the print-receiving tape); a ribbon take-up roller 106 configured to take up the ink ribbon 105 after printing; and a feeding roller 27 rotatably supported near a tape discharging portion of the cartridge 8.

The first roll 102 has the above described base tape 101 wound around a reel member 102*a*. The base tape 101, in this example, comprises a bonding adhesive layer, a base film, an affixing adhesive layer, and a separation sheet, which are layered in that order from the side rolled to the inside toward the opposite side. The second roll 104 has the above described cover film 103 wound around a reel member 104*a*.

The feeding roller 27 presses against the above described base tape 101 and the above described cover film 103 after print formation to adhere the two while feeding, thereby forming the above described label tape 109 with print, and feeds the obtained label tape 109 with print in the direction indicated by arrow A in FIG. 2. Note that the ribbon take-up roller 106 and the feeding roller 27 are rotationally driven in tandem by a driving force of a roller driving motor 208 (refer to FIG. 3 described later) transmitted to the above described ribbon take-up roller driving shaft 107 and the feeding roller driving shaft 108. Furthermore, at the time of this rotational driving, a platen roller 26 disposed facing the thermal head 23 and a pressure roller 28 disposed facing the feeding roller 27 also similarly rotate.

Further, a cutter 40 for cutting the label tape 109 with print in the thickness direction (hereinafter suitably referred to as a "full-cut") is disposed on the downstream side of the feeding roller 27 and the pressure roller 28 along the feeding path of the label tape 109 with print. Furthermore, a half-cutter 40' for partially cutting the label tape 109 with print in the thickness direction (hereinafter suitably referred to as a "half-cut") is disposed on the downstream side of the cutter 40.

Control System of the Print Label Producing Apparatus

Figure 3:
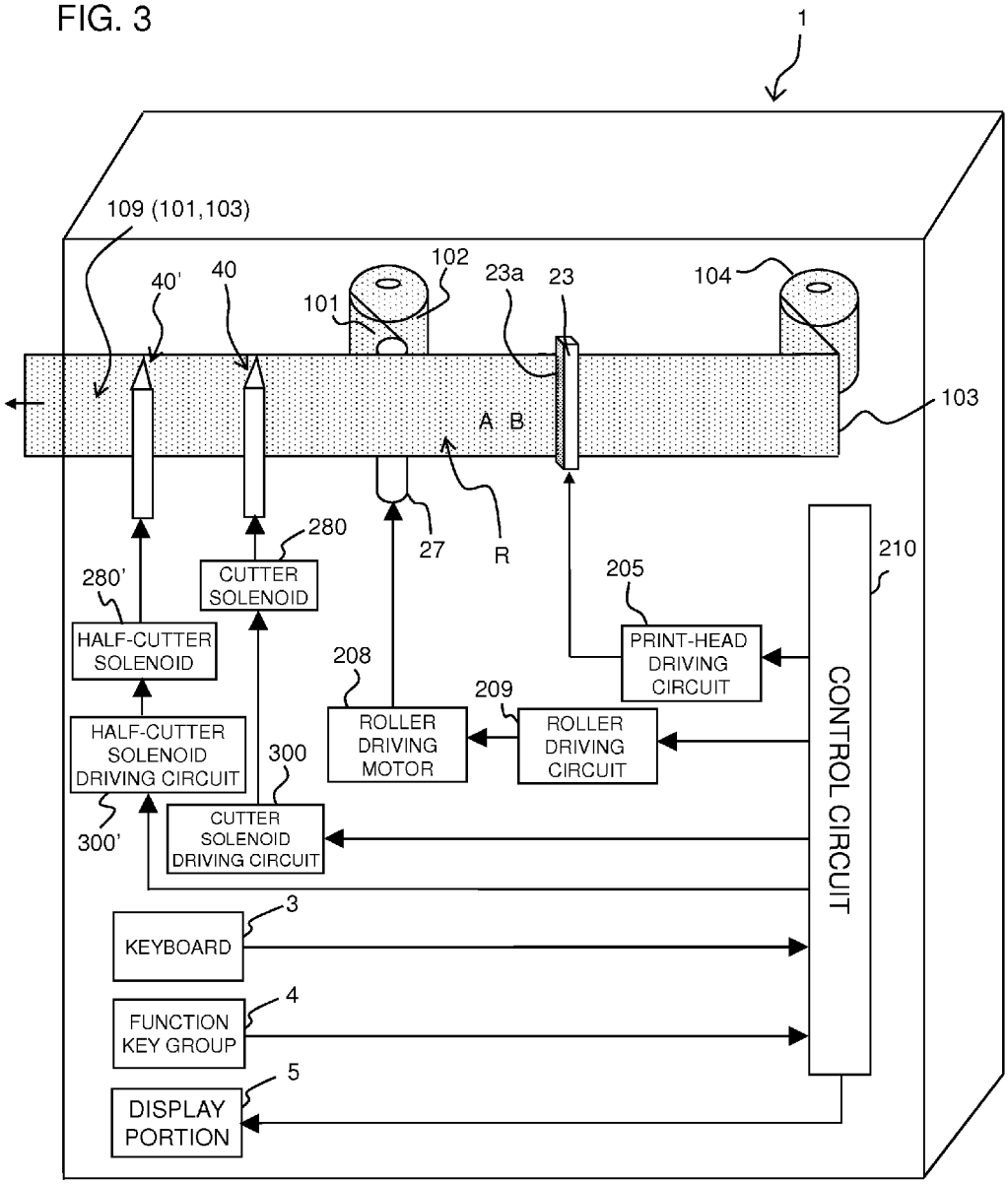
FIG. 3 is a conceptual view showing the control system of the print label producing apparatus.

The control system of the print label producing apparatus 1 will now be described using FIG. 3. In FIG. 3, the print-head driving circuit 205, a roller driving circuit 209, a cutter solenoid driving circuit 300 that controls the power distributed to a cutter solenoid 280 that actuates a full-cut by the cutter 40, a half-cutter solenoid driving circuit 300' that controls the power distributed to a half-cutter solenoid 280' that actuates a half-cut by the half-cutter 40', and the control circuit 210 for controlling the operation of the entire print label producing apparatus 1 via the print-head driving circuit 205, the roller driving circuit 209, the cutter solenoid driving circuit 300, and the half-cutter solenoid driving circuit 300', and the like are disposed on the print label producing apparatus 1.

The roller driving circuit 209 controls the roller driving motor 208 that drives the above described feeding roller driving shaft 108 (refer to FIG. 2) and the ribbon take-up roller driving shaft 107 (refer to FIG. 2). That is, the roller driving circuit 209 controls the rotational speed of the roller driving motor 208, thereby controlling the feeding speed of the label tape 109 with print (in other words, the feeding speed of the cover film 103; hereinafter the same).

The print-head driving circuit 205 distributes power to the heating elements 23*a* of the above described thermal head 23. That is, after the feeding of the label tape 109 with print is started by the driving force of the above described roller driving motor 208, the print-head driving circuit 205 controls the power distributed to the plurality of heating elements 23*a* corresponding to line print data (which divides the print data obtained from the control circuit 210 into single print line units) while switching the power distribution mode per the above described data.

The operation portion 2 inputs an operation signal from the key contacts disposed on the above described key substrate and closed in accordance with the operation of the keyboard 3 and the function key group 4. The control circuit 210 controls the print-head driving circuit 205, the roller driving circuit 209, the roller driving motor 208, the cutter solenoid driving circuit 300, the half-cutter solenoid driving circuit 300', and the like via the control circuit 210, in accordance with the operation of the keyboard 3 and the function key group 4. Further, a display control signal is output from the control circuit 210 in accordance with the operation result of the operation portion 2, and the corresponding display is performed on the display portion 5.

Further, the control circuit 210 is a so-called microcomputer and, though not shown in detail, comprises a CPU which serves as the central processing unit, an ROM, a RAM, and the like. Then, the control circuit 210 performs predetermined processing in accordance with programs (including a print label producing program that executes the print label production flow shown in FIG. 10 and FIG. 11 described later) stored in the ROM in advance while utilizing the temporary storage function of the RAM. Note that the control circuit 210 is supplied with power by a power circuit and connected to a communication line, for example, via a communication circuit, making it possible to communicate information with route servers, other terminals, general-purpose computers, information servers, and the like (not shown) connected to this communication line.

Basic Operation of the Print Label Producing Apparatus

In the print label producing apparatus 1 of the above described configuration, when the cartridge 8 is mounted to the above described cartridge holder 9, the cover film 103 and the ink ribbon 105 are sandwiched between the thermal head 23 and the platen roller 26, while the base tape 101 and the cover film 103 are sandwiched between the feeding roller 27 and the pressure roller 28. Then, the ribbon take-up roller 106 and the feeding roller 27 are synchronously rotationally driven along the directions denoted by arrow B and arrow C, respectively, in FIG. 2 in accordance with the driving of the feeding roller driving shaft 108. The pressure roller 28 rotates by the rotation of the feeding roller 27, the base tape 101 is fed out from the first roll 102 and supplied to the feeding roller 27, and the ink ribbon 105 is fed out from the ribbon supply roller 111 by the rotation of the ribbon take-up roller 106. Further, the platen roller 26 rotates by the feed-out of the ink ribbon 105, and the cover film 103 is fed out from the second roll 104 by the rotation of the feeding roller 27, the pressure roller 28, and the platen roller 26, and supplied to the feeding roller 27. On the other hand, power is distributed to the plurality of heating elements 23*a* of the thermal head 23 by the print-head driving circuit 205, and a desired print object R (the character string "AB . . . " in this example) is formed on the back surface of the cover film 103 fed out from the second roll 104.

Then, the above described base tape 101 and the above described cover film 103 on which printing has been completed are adhered by the above described feeding roller 27 and the pressure roller 28 so as to be integrated, thereby forming the label tape 109 with print, which is then fed to outside the cartridge 8 from the tape discharging portion. The ink ribbon 105, with which formation of the print object R on the cover film 103 has been completed, is then taken up onto the ribbon take-up roller 106 by the driving of the ribbon take-up roller driving shaft 107.

Subsequently, the cutter 40 or the half-cutter 40' operates, fully cutting or half-cutting the label tape 109 with print at a predetermined length to form a print label L (refer to FIG. 4 described later).

Example of Print Label

Hence, the print label producing apparatus 1 is capable of continually producing a plurality of print labels in a preferred order along the feeding direction of the above described label tape 109 with print. FIG. 4 shows an example of a plurality (five in this example) of print labels L1-L5 thus produced.

According to this embodiment, a plurality of blocks BL for arranging the above described print object comprising a character string, barcode, or the like is arranged in the tape length direction on the respective print labels L. Then, a single print object is disposed in the respective blocks. The example shown in FIG. 4 is an example wherein a label body LA (both ends forming a full-cut line FC; detailed described later) in which the print labels L1, L2 are integrated via a half-cut line HC (detailed described later), and a label body LB (both ends forming the full-cut line FC; details described later) in which the print labels L3, L4, L5 are integrated via the half-cut lines HC (details described later) are produced.

In the example shown, two blocks BL1a, BL1b are disposed on the print label L1, and the character "A" and the characters "001" are respectively disposed in the blocks BL1a, BL1b. Two blocks BL2a, BL2b are disposed on the print label L2, and the character "A" and the characters "002" are respectively disposed in the blocks BL2a, BL2b. Further, two blocks BL3a, BL3b are disposed on the print label L3, and the character "B" and the characters "001" are respectively disposed in the blocks BL3a, BL3b. Two blocks BL4a, BL4b are disposed on the print label L4, and the character "B" and the characters "002" are respectively disposed in the blocks BL4a, BL4b. Two blocks BL5a, BL5b are disposed on the print label L5, and the character "B" and the characters "003" are respectively disposed in the blocks BL5a, BL5b.

Figure 4:
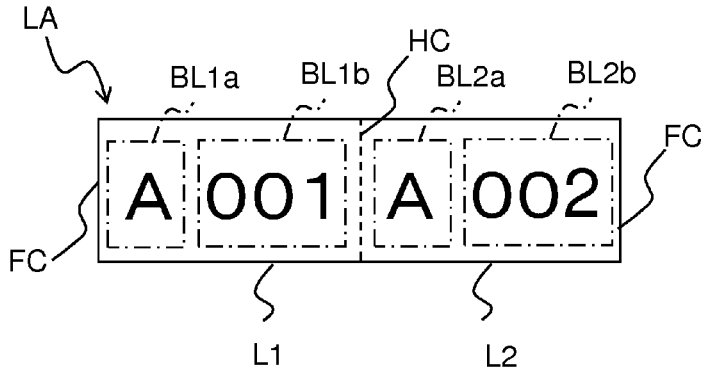
FIG. 4 is a plan view showing an example of the outer appearance of a produced print label.
Figure 4:
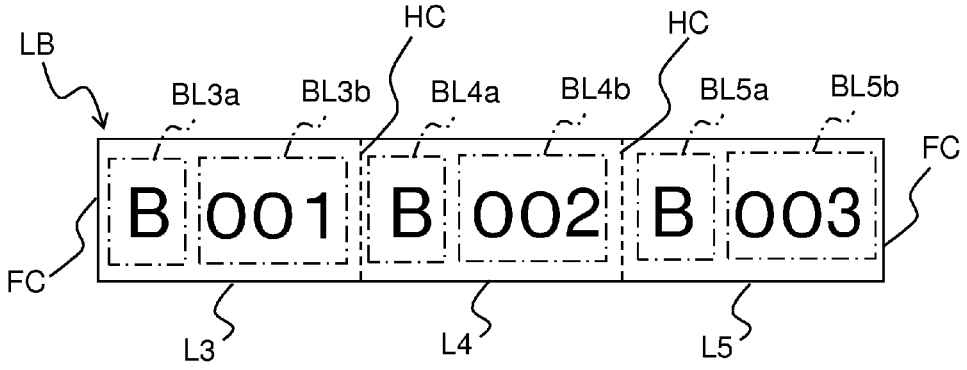

Further, as shown in FIG. 4, according to this embodiment, the character strings of the respective blocks include a print identifier that can be incremented in accordance with a predetermined regularity when a plurality of print labels (the five print labels L1, L2, L3, L4, L5 in this example) is continually produced as described above. That is, in this example, the above described letters "A" "B" and numbers "001" "002" "003" "004" "005" are print identifiers. The above described numbers "001" "002" of the print labels L1, L2 are incremented one by one from "001" "002" in accordance with the production sequence of the print label L1→print label L2, and the above described numbers "001" "002" "003" of the print labels L3, L4, L5 are incremented one by one from "001"→"002"→"003" in accordance with the production sequence of the print label L3→print label L4→print label L5.

Further, the above described letters "A" "B" are incremented one by one from "A" for print labels L1, L2 of the label body LA to "B" for print labels L3, L4, L5 of the subsequent label body LB, in accordance with the production sequence of the label bodies LA, LB.

Special Characteristics of the Embodiment

Then, according to this embodiment, when the print labels L1-L5 such as described above are produced, the various settings made by the operator that pertain to the increments of the above described character strings are received. At that time, in this embodiment, the operator can further set the cutting mode settings (the setting of the above described full-cut line FC and half-cut line HC; described later) corresponding to the above described increment related settings. In the following, details on the functions will be described in order.

Print Object Reception

First, when the operator performs a quantity setup operation for the above described blocks of a single print label (for example, "2" in this example; note that the number may differ from the number of blocks of the produced print label L due to the existence of the above described cutting mode settings as described later) via the keyboard 3 with a suitable initial settings screen (not shown) used for editing displayed on the liquid crystal display portion 2, the setup operation is received. Subsequently, when the operator performs an input operation for the print objects, which include the above described print identifiers respectively disposed in the above described received quantity of blocks, via the keyboard 3, the input operation is received. According to this embodiment, a setting image in relation to the single print label L is generated and displayed on the liquid crystal display portion 2 based on the above described reception result.

Figure 5A:
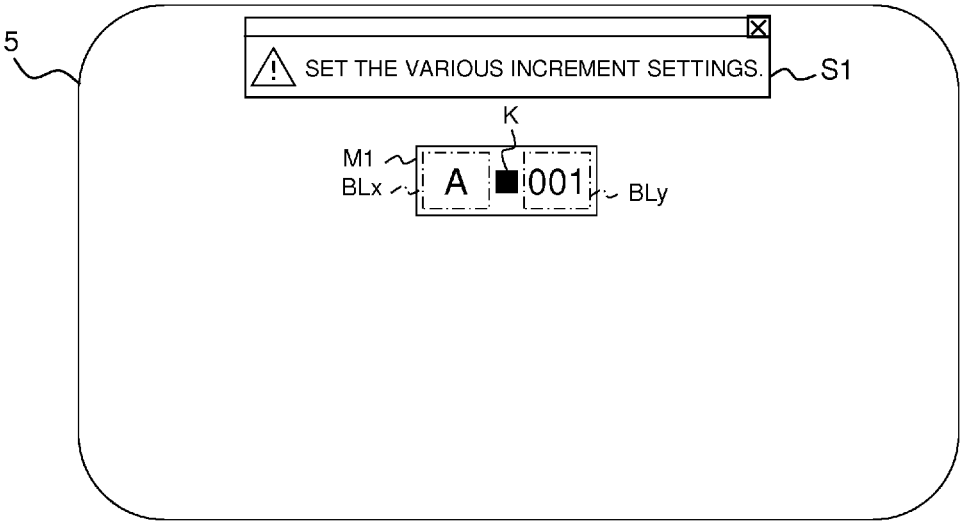
FIG. 5A is an explanatory view showing a display example when various increment related settings are received.

For example, in the example shown in FIG. 5A, the quantity of blocks of a single print label is set to "2" as described above, and the character "A" is input as the print object in a first block BLx while the characters "001" are input as the print object in a second block BLy displayed as a result. With this arrangement, a setting image M1 of the single print label L, which includes the above described characters "A" "001," is displayed on the liquid crystal display portion 2. Note that, as shown in the figure, a new block mark K is displayed between the two blocks BLx, BLy.

Then, according to this embodiment, the above described increment related settings made by the operator are set for the first block BLx. At this time, the range of print identifiers (a letter and number in this example) to be incremented that is specifiable by the operator is two. In other words, the operator can select at least one (that is, one or two) print identifier(s) to be incremented. Note that the message, "Set the various increment settings" is displayed in a setting instruction message area S1 above the above described setting image M1 on the liquid crystal display portion 2.

Figure 5B:
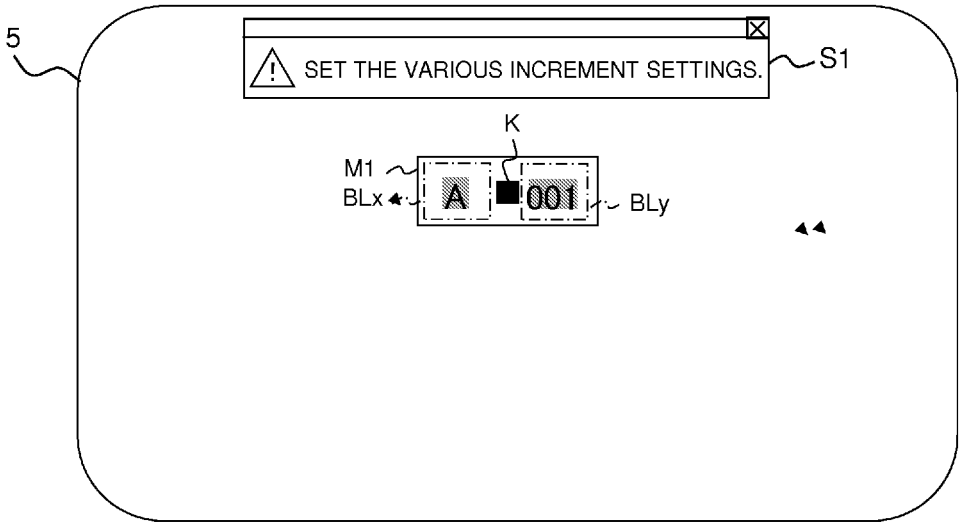
FIG. 5B is an explanatory view showing a display example when various increment related settings are received.

In this example, as shown in FIG. 5B, both the character "A" of the block BLx and the characters "001" of the block Bly are specified as the range of print identifiers to be incremented (refer to the shaded areas).

Increment Mode Reception

Figure 6A:
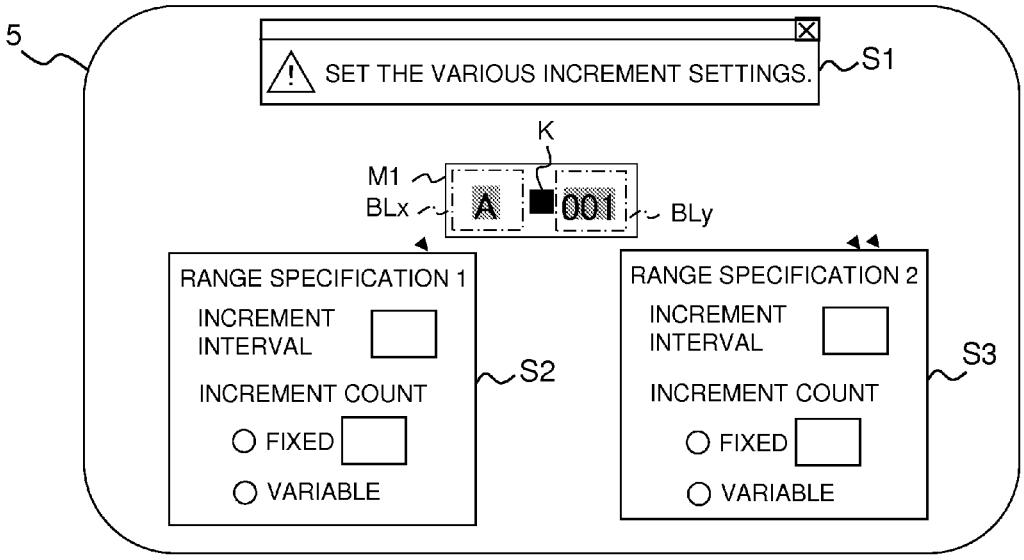
FIG. 6A is an explanatory view showing a display example when various increment related settings are received.

Specifying the range as described above displays an increment mode specification area S2 in relation to the first increment target (displayed as "Range specification 1" in the figure), and an increment mode specification area S3 in relation to the second increment target (displayed as "Range specification 2" in the figure) on the left and right sides below the above described setting image M1 in this example, as shown in FIG. 6A. The increment mode specification areas S2, S3 each display an "Increment Interval" box that permits input of the increment interval setting that indicates the size of one increment, and increment count buttons for selecting if the increment execution count setting is to be set to a fixed value or made variable (if the setting is set to a fixed value, a number box that permits input of that number is also displayed).

Figure 6B:
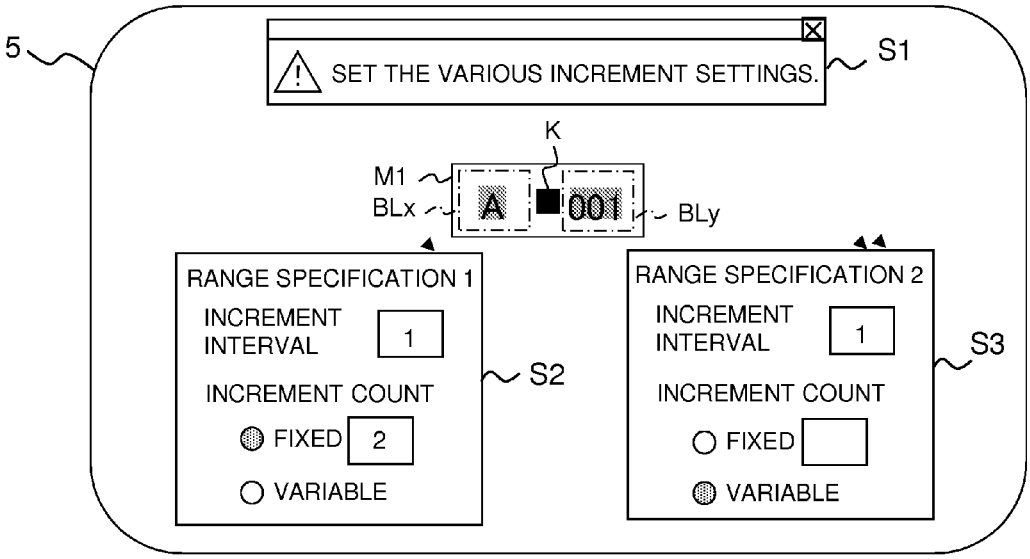
FIG. 6B is an explanatory view showing a display example when various increment related settings are received.

In the example shown in FIG. 6B, in the increment mode specification area S2, the character "A" is set to an increment interval of 1 by the "Increment Interval" box. Further, for the increment execution count, the "Fixed" increment count button, which indicates a fixed value, is checked and the number thereof is set to "2" in the number box. Similarly, in the increment mode specification area S3, the characters "001" are set to an increment interval of 1 by the "Increment Interval" box. Further, for the increment execution count, the "Variable" increment count button, which indicates a variable setting, is checked.

Figure 7A:
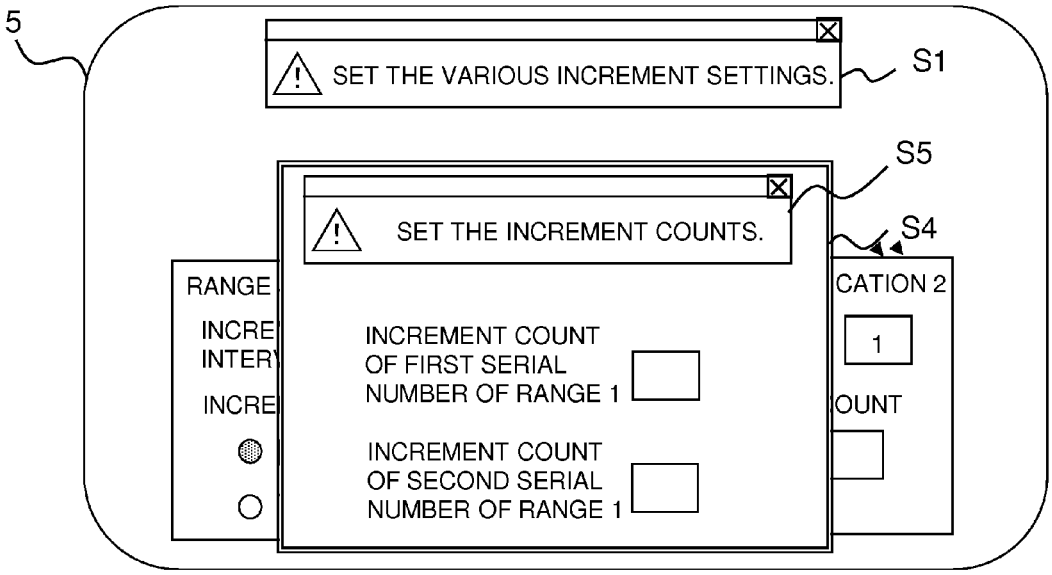
FIG. 7A is an explanatory view showing a display example when a variable setting of the increment count is received.

Hence, according to this embodiment, the increment count of one print identifier can be set to variable for each other print identifier. That is, in this example, when "Variable" is selected as the increment execution count in the above described increment mode specification area S3, an increment count setting screen S4 is displayed in the form of an interrupt window, as shown in FIG. 7A. In this example, in accordance with the fact that the increment interval and the increment execution count of the character "A" is 1 and (fixed to) 2, respectively, as previously described, a setting box for the increment count of the characters "001" for the first serial number (during the first increment of the character "A"), and a setting box for the increment count of the characters "001" for the second serial number (during the second increment of the character "A"; in other words, when the character is "B") are displayed on the above described increment count setting screen S4. Note that the message, "Set the increment counts" is displayed in a setting instruction message area S5 at the top of the increment count setting screen S4.

Figure 7B:
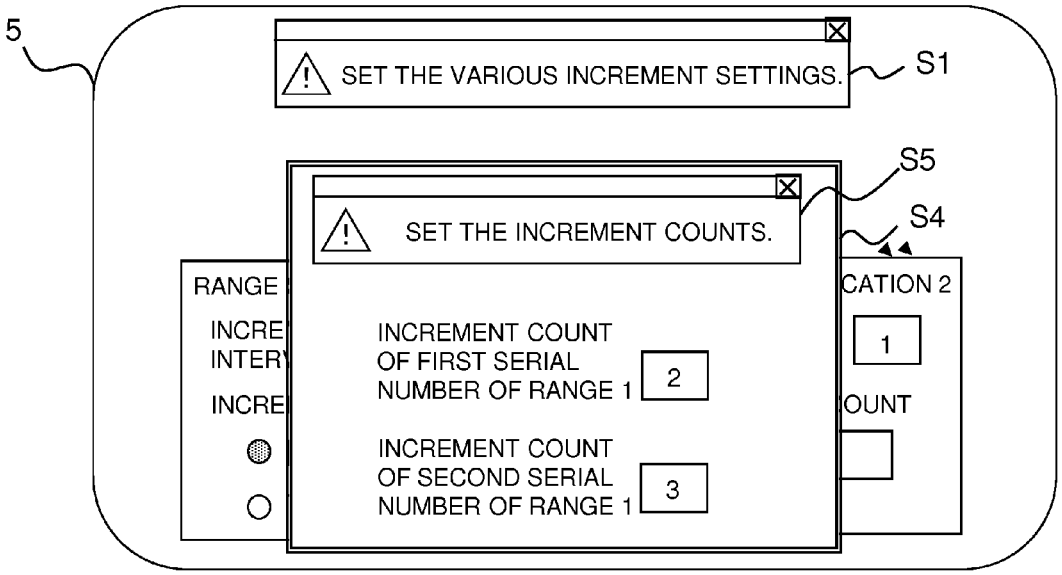
FIG. 7B is an explanatory view showing a display example when a variable setting of the increment count is received.

In the example shown in FIG. 7B, the increment count of the characters "001" for the first serial number (during the first increment of the character "A") is set to 2 (that is, from characters "001"→"002") by the above described increment count setting box on the increment count setting screen S4. Further, the increment count of the characters "001" for the second serial number (during the second increment of the character "A"; that is, when the character is "B") is set to 3 (that is, from characters "001"→"002"→"003").

Figure 8:
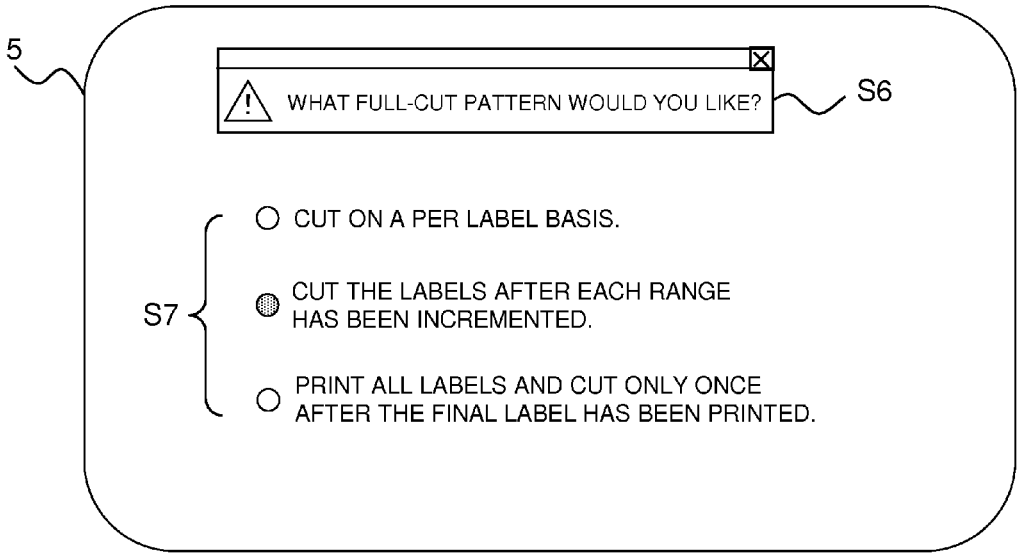
FIG. 8 is an explanatory view showing a display example when a full-cut pattern setting is received.

When the respective increment interval and increment execution count settings of the characters "A" "B" of the setting image M1 are all completed as described above, a full-cut pattern setting area S7 in relation to the above described full-cut pattern setting is displayed as one of the cutting mode settings, as shown in FIG. 8. In this example, three checkboxes are prepared, namely a "Cut on a per label basis" checkbox for executing a full-cut between all two adjacent print labels L, a "Cut the labels after each range has been incremented" checkbox for executing a full-cut every time each print identifier has been incremented, and a "Print all labels and cut only once after the final label has been printed" checkbox for executing a full-cut only after production of the print label having the last sequential number among all print labels to be produced (in other words, a mode where all print labels are connected to each other), and these three full-cut modes are available for selection. The example shown shows an example in which the mode for executing a full-cut every time each print identifier has been incremented is selected. The message, "What full-cut pattern would you like?" is displayed in a setting instruction message area S6 above the full-cut pattern setting area S7.

Figure 9:
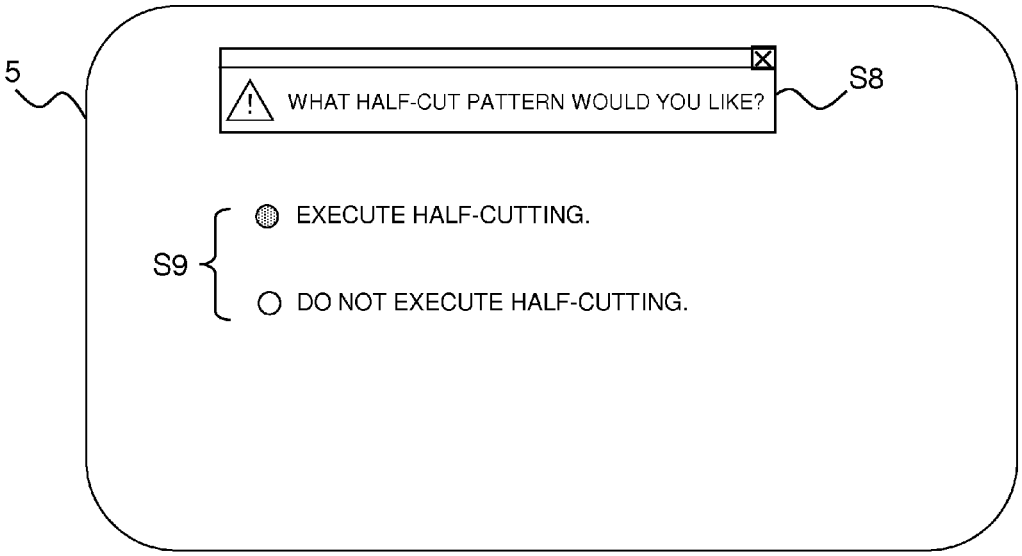
FIG. 9 is an explanatory view showing a display example when a half-cut pattern setting is received.

When the setting of the full-cut mode is completed as described above, a half-cut pattern setting area S9 in relation to the above described half-cut pattern setting is displayed as one of the cutting mode settings, as shown in FIG. 9. In this example, two checkboxes are prepared, namely an "Execute half-cutting" checkbox for executing a half-cut between all two adjacent print labels L in areas other than the full-cut position set as described above, and a "Do not execute half-cutting" checkbox for not executing a half-cut between all two adjacent print labels L in areas other than the above described full-cut position, and these two half-cut modes are available for selection. The example shown shows an example in which the mode for executing the above described half-cutting is selected. The message, "What half-cut pattern would you like?" is displayed in a setting instruction message area S8 above the half-cut pattern setting area S9.

Then, with the selection of one of the two types of half-cut modes shown in the above described FIG. 9, the print formation by the thermal head 23 and the full-cutting and the half-cutting by the cutter 40 and the half-cutter 40' are executed so as to achieve the increment mode and cutting mode of the respective selections in FIGS. 5-9, thereby producing the corresponding number of print labels L. For example, in a case where the full-cut mode "Cut the labels after each range has been incremented" and the half-cut mode "Execute half-cutting" are selected with the increment settings of 2 as the increment count of characters "001" when the character is "A" and 3 as the increment count of the characters "001" when the character is "B" as previously described in the above described FIGS. 5-9, two label bodies (a total of five print labels) can be produced, including the first label body LA (with the full-cut line FC on both ends) comprising the print label L1 wherein the character string "A 001" is disposed and the print label L2 wherein the character string "A 002" is disposed, with the half-cut line HC formed therebetween, and the first label body LB (with the full-cut line FC on both ends) comprising the print label L4 wherein the character string "B 001" is disposed, the print label L5 wherein the character string "B 002" is disposed, and a print label L6 wherein the character string "B 003" is disposed, with the half-cut lines HC formed between the respective print labels L4, L5, L6, as shown in the aforementioned FIG. 4.

Control Steps

Figure 10:
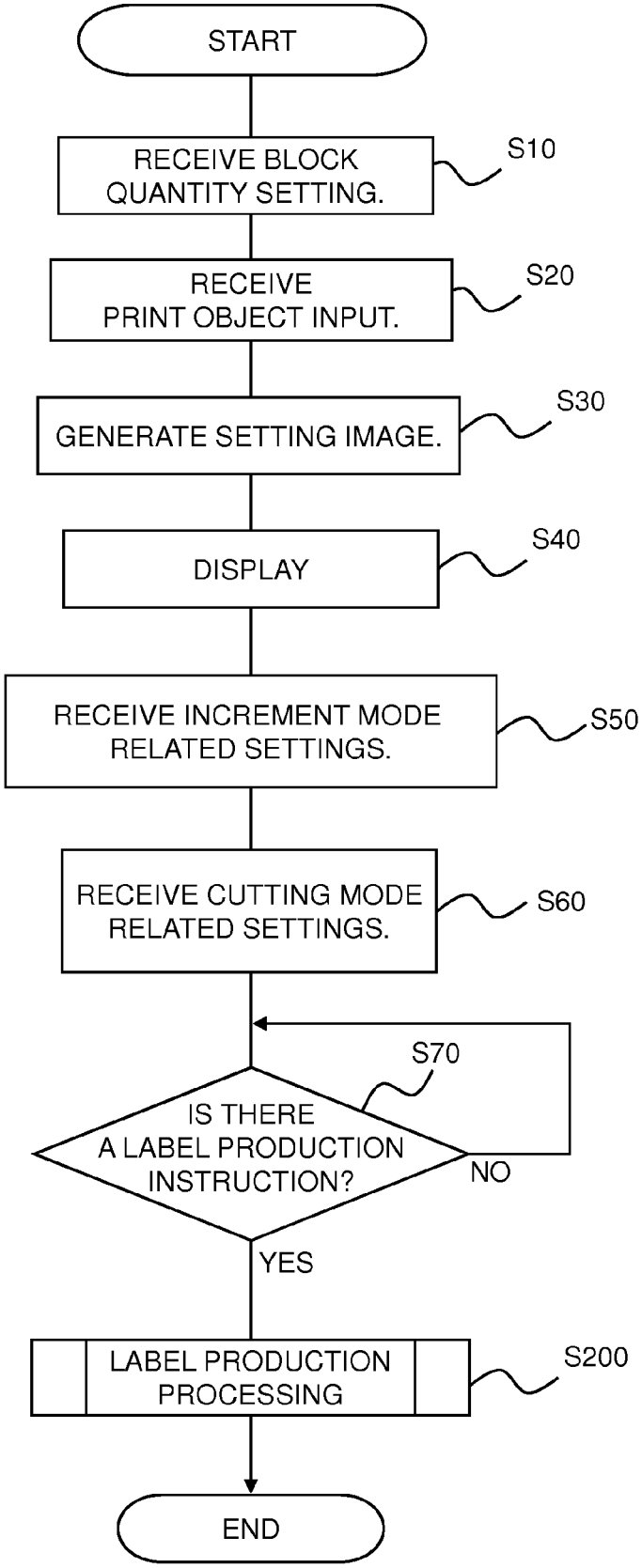
FIG. 10 is a flowchart showing the control steps executed by the control circuit.
Figure 11:
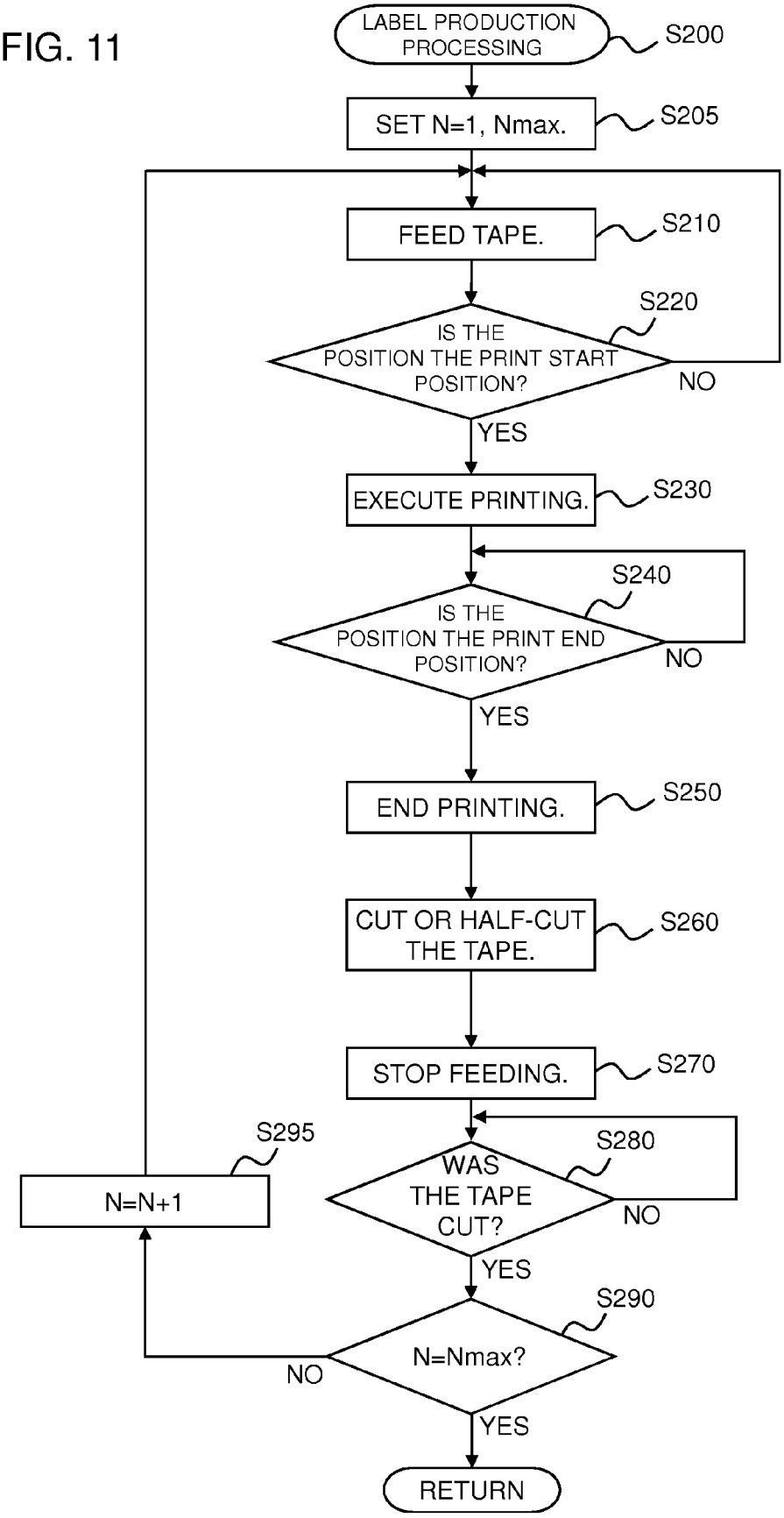
FIG. 11 is a flowchart which shows the detailed procedure of step S200.

The following describes the control steps in relation to the printing method executed by a CPU 44 of the label producing apparatus 1 for achieving the above described technique, using the flowchart of FIG. 10 and FIG. 11.

In FIG. 10, the processing shown by this flow is started by turning the power supply of the print label producing apparatus 1 ON, for example.

First, in step S10, the control circuit 210 receives a quantity setup operation for the blocks in a single print label, performed by the operator via the operation portion 2 with the aforementioned initial settings screen used for editing displayed.

Subsequently, the flow proceeds to step S20 where the control circuit 210 receives an input operation for the print objects, such as a character string or the like (including the letters and numbers to be incremented), to be respectively disposed in the quantity of blocks (the two blocks BLx, BLy in the aforementioned example) received in the above described step S5, via the operation portion 2.

Subsequently, the flow proceeds to step S30 where the control circuit 210 generates the single setting image M1 wherein the quantity of blocks received in the above described step S5, respectively comprising the print objects received in the above described step S20, is arranged in the tape length direction.

Then, in step S40, the control circuit 210 outputs a control signal to the display portion 5 and displays the setting image M1 generated in the above described step S30 on the display portion 5 (refer to FIG. 5A).

Subsequently, the flow proceeds to step S50 where the control circuit 210 receives various setup operations related to the increment mode made by the operator via the operation portion 2. Note that the increment related setup operations for the print label that are received in this step S50 include, for example, setup of the print identifiers to be incremented (range setup; refer to FIG. 5B), setup of the increment interval (refer to FIG. 6B), setup of the increment execution count (refer to FIG. 6B and FIG. 7B), and the like as described above.

Subsequently, the flow proceeds to step S60 where the control circuit 210 receives settings related to the cutting mode (the full-cut mode by the cutter 40 and the half-cut mode of the half-cutter 40'). That is, the control circuit receives a setting (refer to FIG. 8) indicating whether or not the operator wants to execute full-cutting by the cutter 40 at the respective boundaries between two adjacent print labels (in other words, which boundary areas are to be fully cut), and a setting (refer to FIG. 9) indicating whether or not the operator wants to execute half-cutting by the half-cutter 40' at the respective boundaries between two adjacent print labels, excluding the full-cut position (in other words, which boundary areas between two adjacent print labels excluding the full-cut position are to be half-cut), in accordance with the above described increment mode.

Then, in step S70, the control circuit 210 determines whether or not a predetermined label production instruction was input via the operation portion 2. Until the label production instruction is input, the condition of step S70 is not satisfied (S70: NO), and the flow loops back and enters a standby state. Once a label production instruction is input, the condition of step S70 is satisfied (S70: YES), and the flow proceeds to step S200.

In step S200, the control circuit 210 executes label production processing whereby the print label L corresponding to the increment mode and cutting mode received in the above described step S50 and step S60 is produced. The processing indicated in this flow then terminates here.

The detailed steps of the label production processing of the above described step S200 will now be described using FIG. 11.

In FIG. 11, first, in step S205, the control circuit 210 sets the value of a variable N in relation to the number of print labels L to be produced to 1. At this same time, the control circuit 210 sets a maximum value Nmax of the above described variable N in accordance with the selections (increment interval, increment count, and the like) of the increment mode received in the above described step S50.

Subsequently, in step S210, the control circuit 210 outputs a control signal to the roller driving circuit 209 and starts the driving of the roller driving motor 208. As a result, the rotation of the platen roller 26 and the like is started, and the feeding of the cover film 103, the base tape 101, and the label tape 109 with print is started.

Subsequently, the flow proceeds to step S220 where the control circuit 210 determines whether or not the feeding direction position of the cover film 103 has arrived at a predetermined print start position by a known technique. Until the feeding direction position arrives at the print start position, the condition of step S220 is not satisfied (S220: NO), the flow returns to the above described step S210, and the same step is repeated. Once the feeding direction position arrives at the print start position, the condition of step S220 is satisfied (S220: YES), and the flow proceeds to step S230.

In step S230, the control circuit 210 outputs a control signal (print data) in accordance with the label of the sequential number corresponding to the value of the variable N at this moment when the print identifier is sequentially incremented based on the increment mode set in the above described step S150, to the print-head driving circuit 205. As a result, the thermal head 23 is driven in accordance with the above described print data, and formation of the print object corresponding to the print data is started on the cover film 103.

Then, in step S240, the control circuit 210 determines whether or not the feeding direction position of the cover film 103 has arrived at a desired print end position by a known technique. Until the feeding direction position arrives at the print end position, the condition of step S240 is not satisfied (S240: NO), and the flow loops back and enters a standby state. Once the feeding direction position arrives at the print end position, the condition of step S240 is satisfied (S240: YES), and the flow proceeds to step S250.

In step S250, the control circuit 210 outputs a control signal to the print-head driving circuit 205, and stops the driving of the thermal head 23 to terminate printing.

Subsequently, the flow proceeds to step S260 where the control circuit 210 determines whether or not the feeding direction position of the label tape 109 with print has arrived at the tape cutting position (the above described full-cut line FC or half-cut line HC) by a known technique. Until the feeding direction position arrives at the tape cutting position, the condition of step S260 is not satisfied (S260: NO), and the flow loops back and enters a standby state. Once the feeding direction position arrives at the tape cutting position, the condition of step S260 is satisfied (S260: YES), and the flow proceeds to step S270.

In step S270, the control circuit 210 outputs a control signal to the roller driving circuit 209 and stops the driving of the motor 208. As a result, the rotation of the platen roller 26 and the like stops, and the feeding of the cover film 103, the base tape 101, and the label tape 109 with print stops.

Then, in step S280, the control circuit 210 outputs a control signal to the cutter solenoid driving circuit 300 (or half-cutter solenoid driving circuit 300'), drives the cutter 40 (or the half-cutter 40') via the cutter solenoid 280 (or half-cutter solenoid 280'), and fully cuts (or half-cuts) the label tape 109 with print. Subsequently, the flow proceeds to step S290. Note that the label tape 109 with print is fully cut or half-cut (or neither fully cut by the cutter 40 nor half-cut by the half-cutter 40' according to the above described cutting mode setting), thereby producing the print label L of the sequential number corresponding to the value of the variable N at the moment.

In step S290, the control circuit 210 determines whether or not the value of the variable N has reached the maximum number Nmax. Until the value of the variable N reaches the maximum number Nmax, the condition of step S290 is not satisfied (S290: NO) and the flow proceeds to step S295. In step S295, the control circuit 210 adds 1 to the value of the variable N, the flow returns to the above described step S210, and the same steps are repeated. On the other hand, once the value of the variable N reaches the maximum number Nmax, the condition of step S290 is satisfied (S290: YES), and this routine is terminated. With the above, the above described Nmax print labels L are all produced.

Note that the present disclosure is not limited to the above described embodiment, and various modifications may be made without deviating from the spirit and scope of the disclosure. The following describes such modifications. Note that components identical to those in the above described embodiment are denoted using the same reference numerals, and descriptions thereof will be omitted or simplified as appropriate.

(1) When the increment counts of the respective print identifiers of the two blocks are set to "Fixed"

Figure 12A:
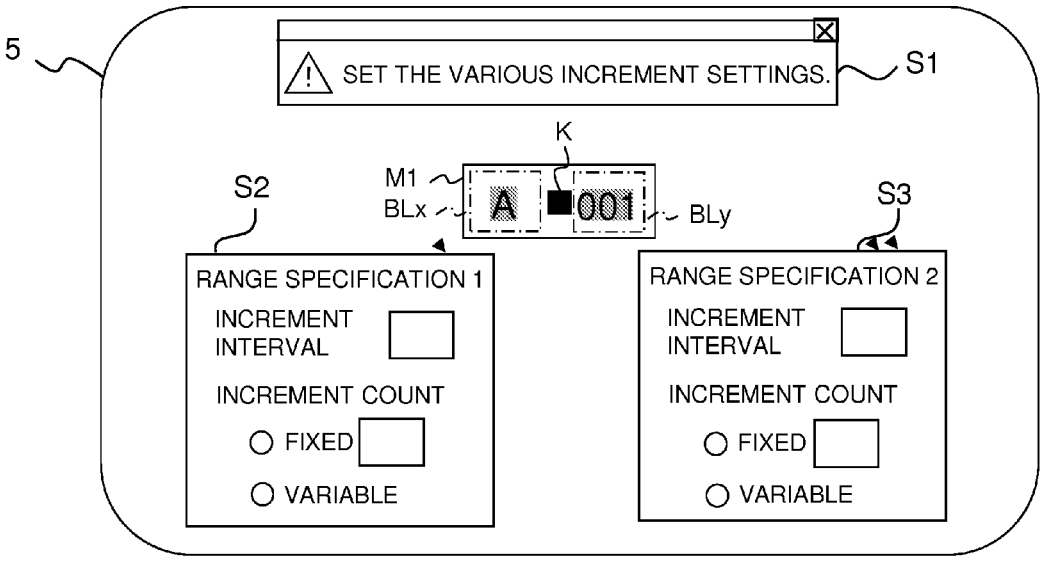
FIG. 12A is an explanatory view showing a display example when various increment related settings are received in a modification where the increment execution count of the print identifier of each block is fixed.
Figure 12B:
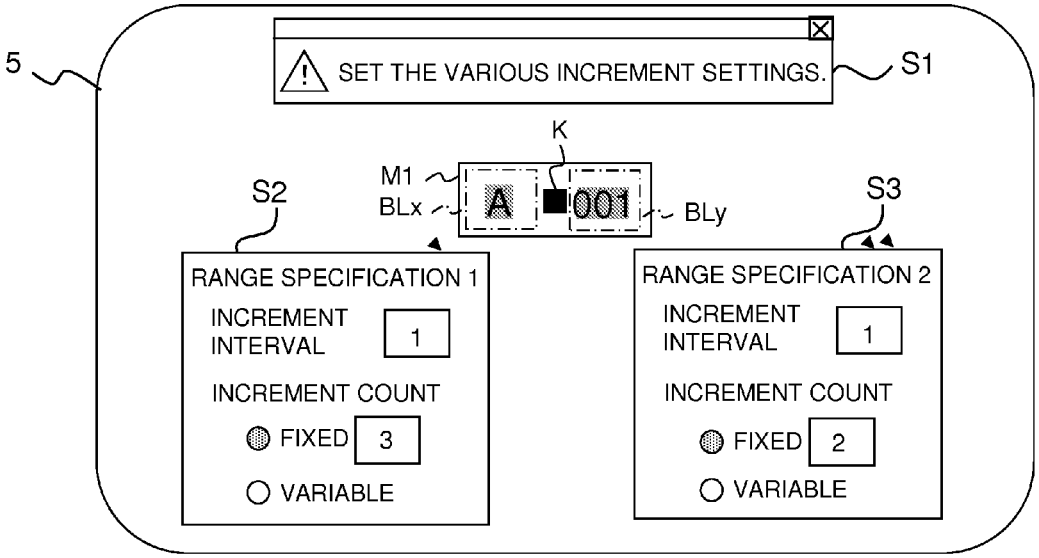
FIG. 12B is an explanatory view showing a display example when various increment related settings are received in a modification where the increment execution count of the print identifier of each block is fixed.

FIG. 12 shows a display example (corresponding to FIG. 5 of the above described embodiment) when the various increment related settings are received in this modification. As shown in FIG. 12A, in this example, as described above, the characters "A" "001" are respectively input as print objects in the blocks BLx, BLy, and the setting image M1 of the single print label L which includes the above described characters "A" "001" is displayed on the liquid crystal display portion 2. Then, as shown in FIG. 12B, both the character "A" of the block BLx and the characters "001" of the block BLy are specified as the range of print identifiers to be incremented (refer to the shaded areas), as in the above described FIG. 5B.

At this time, in this example, as shown in FIG. 12B, in the increment mode specification area S2, the character "A" is set to an increment interval of 1 by the "Increment Interval" box and, for the increment execution count, the "Fixed" increment count button is checked and the number thereof is set to "3" in the number box. Then, in the increment mode specification area S3, the characters "001" are set to an increment interval of 1 by the "Increment Interval" box and, for the increment execution count, the "Fixed" increment count button is checked and the number thereof is set to "2" in the number box.

Figure 13:
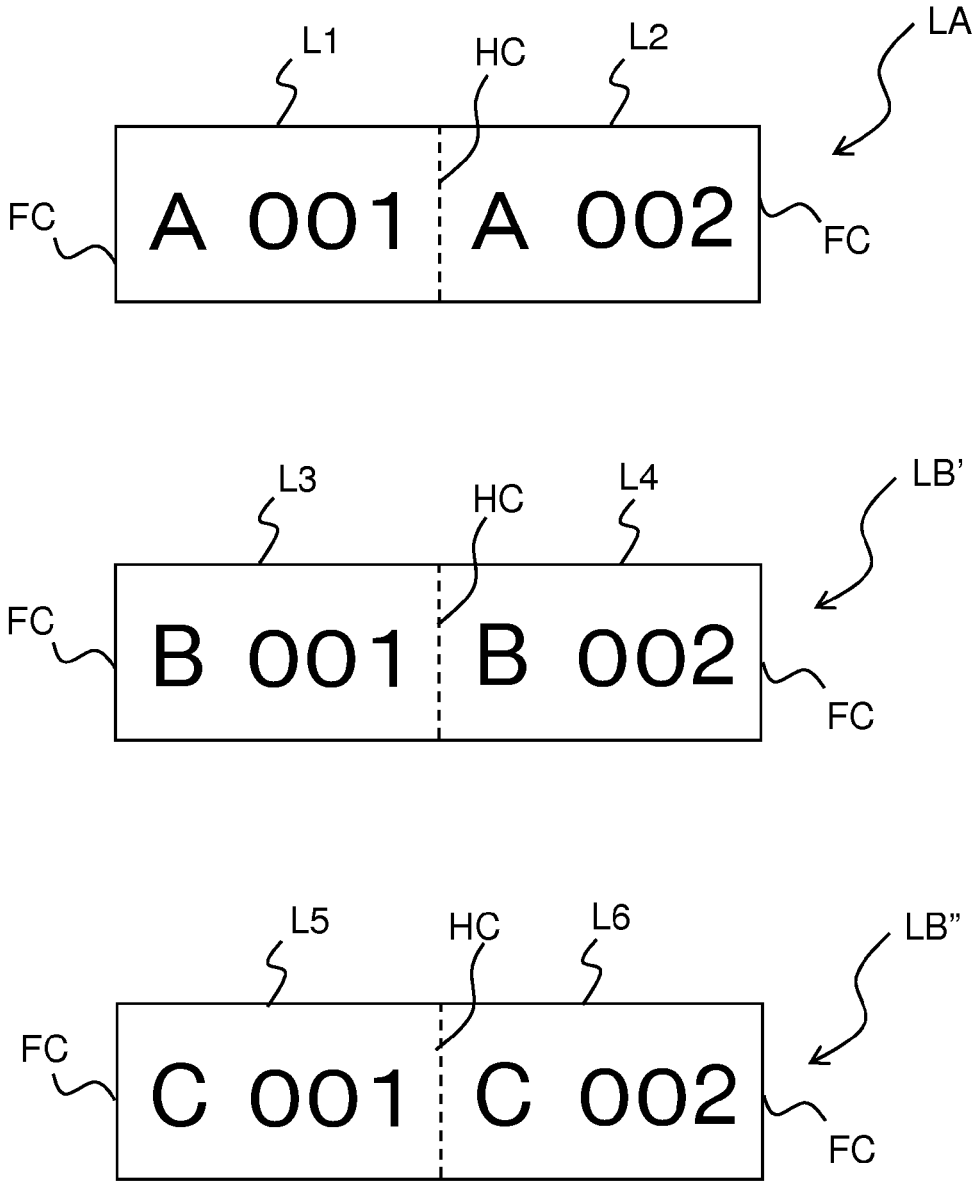
FIG. 13 is a plan view showing an example of the outer appearance of a produced print label.

FIG. 13 shows the print label L produced in a case where the respective increment interval and increment execution count settings of the characters "A" and "B" such as described above are completed, and the same full-cut pattern and half-cut pattern selections as in FIG. 8 and FIG. 9 of the above described embodiment are further made.

As shown in FIG. 13, in this modification, the label body LA wherein the print labels L1, L2 are integrated via the half-cut line HC, a label body LB' wherein the print labels L3, L4 are integrated via the half-cut line HC, and a label body LB" wherein the print labels L5, L6 are integrated via the half-cut line HC are produced.

At this time, as the result of the aforementioned settings, the print of the character string "A 001" is formed on the print label L1, and the print of the character string "A 002" is formed on the print label L2 by techniques similar to those described above. Further, the print of the character string "B 001" is formed on the print label L3, and the print of the character string "B 002" is formed on the print label L4. Further, the print of the character string "C 001" is formed on the print label L5, and the print of the character string "C 002" is formed on the print label L6.

(2) Other

Further, the arrows shown in FIG. 3 denote an example of signal flow, but the signal flow direction is not limited thereto.

Also note that the present disclosure is not limited to the steps shown in the flowchart of FIG. 10 and FIG. 11; step additions and deletions as well as sequence changes may be made without deviating from the spirit and scope of the disclosure.

Further, other than that already stated above, techniques based on the above described embodiment and the like may be suitably utilized in combination as well.

Although other examples are not individually described herein, various changes can be made according to the present disclosure without deviating from the spirit and scope of the disclosure.

What is claimed is:

1. A printer comprising:

a feeder configured to feed a print-receiving tape;

a printing-head configured to perform desired printing of a print object on said print-receiving tape fed by said feeder; and a cutter configured to cut said print-receiving tape on which printing has been performed by said printing-head;

said printer being configured to continually produce a plurality of printed matter wherein said print object is respectively formed on said print-receiving tape in a predetermined order along a feeding direction of said feeder, and further comprising:

a print object receiving portion configured to receive an input operation for said print object which is disposed in at least one block that is set in a tape length direction in relation to a single said printed matter and includes a print identifier that is incremented in accordance with a predetermined regularity;

an increment mode receiving portion configured to receive a setup operation for an increment mode when said print identifier of said print object is to be incremented;

a cutting mode receiving portion configured to receive a setup operation for a cutting mode by said cutter at a boundary between two adjacent printed matter included in said plurality of printed matter, in accordance with the increment mode received by said increment mode receiving portion; and a printing control portion configured to control said feeder and said printing-head to generate a plurality of said printed matter in which is respectively formed said print object which includes said print identifier incremented in accordance with a reception result of said print object receiving portion and said increment mode receiving portion, and which is cut using the cutting mode received by said cutting mode receiving portion.

2. The printer according to claim 1, wherein:

said increment mode receiving portion receives at least said setup operation in relation to a specification of a print identifier to be incremented and an increment execution count as said increment mode.

3. The printer according to claim 2, wherein:

said print object receiving portion receives the input operation for a plurality of said print objects respectively disposed in a plurality of blocks set in the tape length direction in relation to a single said printed matter;

said increment mode receiving portion receives said setup operation for setting the respective print identifiers of said plurality of blocks as print identifiers to be incremented and sequentially executing incrementing in an amount equivalent to said increment execution count per said print identifier of each block; and said cutting mode receiving portion receives said setup operation for executing cutting between said printed matter wherein the incrementing of said print identifier of a block has been completed in an amount equivalent to said increment execution count, and a printed matter that is to be produced following said printed matter.

4. The printer according to claim 3, wherein:

said print object receiving portion receives the input operation for a plurality of said print objects respectively disposed in said plurality of blocks that includes a first block and a second block; and said increment mode receiving portion receives said setup operation wherein said increment execution count at a time said print identifier of said second block is to be incremented when said first block is in a first incremented state, and said increment execution count at a time said print identifier of said second block is to be incremented when said first block is in a second incremented state differ from each other.

5. The printer according to claim 1, further comprising a half-cutter configured to partially cut said print-receiving tape on which printing has been performed by said printing-head in a thickness direction of the print receiving tape, wherein:

said cutting mode receiving portion receives said setup operation for executing partial cutting by said half-cutter at boundaries where cutting by said cutter is not performed among all said boundaries in relation to said plurality of printed matter.

6. A printing method executed by a printer that comprises a feeder configured to feed a print-receiving tape, a printing-head configured to perform desired printing of a print object on said print-receiving tape fed by said feeder, and a cutter configured to cut said print-receiving tape on which printing has been performed by said printing-head, and is configured to continually produce a plurality of printed matter wherein said print object is respectively formed on said print-receiving tape in a predetermined order along a feeding direction of said feeder, said printing method comprising the steps of:

a print object receiving step for receiving an input operation for said print object which is disposed in at least one block that is set in a tape length direction in relation to a single said printed matter and includes a print identifier that is incremented in accordance with a predetermined regularity;

an increment mode receiving step for receiving a setup operation for an increment mode when said print identifier of said print object is to be incremented;

a cutting mode receiving step for receiving a setup operation for a cutting mode by said cutter at a boundary between two adjacent printed matter included in said plurality of printed matter, in accordance with an increment mode received in said increment mode receiving step; and a printing control step for controlling said feeder and said printing-head to generate a plurality of said printed matter in which is respectively formed said print object which includes said print identifier incremented in accordance with a reception result of said print object receiving step and said increment mode receiving step, and which is cut using the cutting mode received in said cutting mode receiving step.

* * * * *